US011498797B2

(12) United States Patent
Pauly

(10) Patent No.: US 11,498,797 B2
(45) Date of Patent: Nov. 15, 2022

(54) LEVEL WIND DEVICE

(71) Applicant: SpinOlution, LLC, Winlock, WA (US)

(72) Inventor: Michael G. Pauly, Winlock, WA (US)

(73) Assignee: SpinOlution, LLC, Winlock, WA (US)

( * ) Notice: Subject to any disclaimer, the term of this patent is extended or adjusted under 35 U.S.C. 154(b) by 159 days.

(21) Appl. No.: 17/063,478

(22) Filed: Oct. 5, 2020

(65) Prior Publication Data

US 2022/0106150 A1 Apr. 7, 2022

(51) Int. Cl.

| | |
|---|---|
| ***B65H 54/28*** | (2006.01) |
| ***D01H 1/04*** | (2006.01) |
| ***D01H 7/36*** | (2006.01) |

(52) U.S. Cl.

CPC ..... *B65H 54/2848* (2013.01); *D01H 1/04* (2013.01); *D01H 7/36* (2013.01)

(58) Field of Classification Search

CPC ..... B65H 54/2848; B65H 54/2836; B65H 54/28; B65H 54/02; D01H 1/04; D01H 7/36; D01H 7/46; D01H 7/48; D01H 7/50; D01H 7/38

USPC ..... 57/67

See application file for complete search history.

(56) References Cited

U.S. PATENT DOCUMENTS

| | | | | | |
|---|---|---|---|---|---|
| 246,251 | A | * | 8/1881 | Voegtli | D01H 3/00 57/67 |
| 808,084 | A | * | 12/1905 | Hardman | B65H 54/2896 242/484.1 |
| 3,848,405 | A | * | 11/1974 | Karlson | B65H 54/02 242/472.6 |
| 4,196,575 | A | * | 4/1980 | Novak | D01H 9/14 57/131 |
| 4,204,392 | A | * | 5/1980 | Bock | D02G 3/385 57/18 |
| 4,458,474 | A | * | 7/1984 | Lee | D01H 3/00 57/71 |

FOREIGN PATENT DOCUMENTS

| | | | | | |
|---|---|---|---|---|---|
| DE | 3302724 | A1 | * | 8/1984 | D01H 7/30 |
| GB | 191016897 | A | * | 5/1911 | D01H 13/302 |
| GB | 199704 | A | * | 9/1923 | D01H 7/30 |
| GB | 247082 | A | * | 2/1926 | D01H 7/26 |

* cited by examiner

*Primary Examiner* — Khoa D Huynh
*Assistant Examiner* — Grace Huang

(57) ABSTRACT

A flyer assembly including a spindle rotatable about an axis of rotation, an arm coupled to the spindle, a level wind device axially mounted to the arm, a first friction member disposed along a width of the level wind device and shaped into a convex curve defining the width of the level wind device, a second friction member offset from the first friction member, and a fulcrum having an eye or hook.

14 Claims, 4 Drawing Sheets

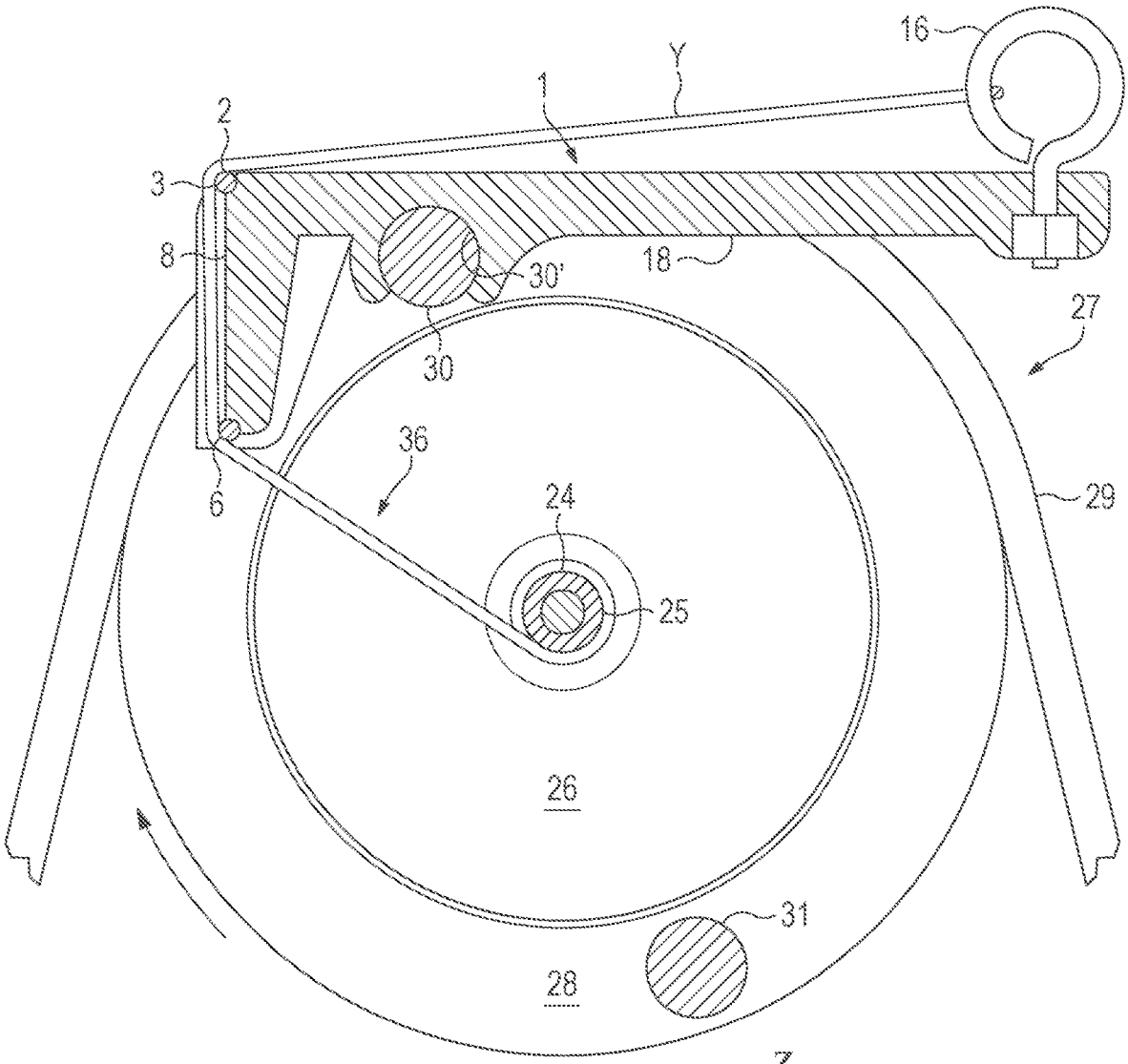
FIG. 4
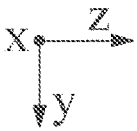

LEVEL WIND DEVICE

BACKGROUND

1. Field of the Invention

The present disclosure relates generally to spooling and winding applications and more specifically, to a flyer assembly for manually operated spinning wheels.

2. Description of the Related Art

When it comes to packaging materials of exceptionally long length such as thread, film, wire, and thermoplastics, spooling is probably the most convenient way. In spooling and winding applications, the integrity of the spool is based on adequate and proper tension, as well as material takeup, in order to produce various winding patterns. A level wind is one example of a spool winding pattern. In a level wind the turnaround ends of each layer of wound material are at the same two points spanning the spool.

Electromechanical spooling machines typically use a traverse mechanism, actuated by a motor, to distribute the spun material onto the spool as the traverse mechanism travels from side-to-side between the flanges of the spool. In an industrial application, these machines are operated with precise control to spool the material in a pattern of choice.

Manually or treadle operated spinning wheels, are designed with flyer hooks and repositionable flyer hooks, which are used to prevent dwell points along the axial length of the bobbin. This requires stopping the wheel, removing the yarn from one flyer hook and looping it on another. Even if the flyer hooks are repositionable at strategic points along the flyer arm, the yarn cannot be distributed continuously onto the bobbin.

Another design of a manually operated spinning wheel, uses a traveler with a hook or eye mounted on top of the traveler, which travels lengthwise along a slot within one of the flyer arms of an open ended flyer. A uniform spooling of yarn is achieved as the yarn is distributed continuously onto the bobbin without having to stop and restart the drive wheel.

SUMMARY

A flyer assembly including a spindle rotatable about an axis of rotation, the flyer assembly including an arm coupled to the spindle and radially spaced from the axis of rotation extending substantially parallel to the axis and a level wind device axially mounted to the arm. The flyer assembly including a first friction member disposed along a width of the level wind device and shaped into a convex curve defining the width of the level wind device and a second friction member offset from the first friction member linearly extending along the width of the level wind device. The flyer assembly including a fulcrum having an eye or hook, the fulcrum pivotally adjustable, wherein a material of length threaded through the eye or the hook of the fulcrum frictionally engages the first friction member followed by the second friction member in operation of a spinning wheel used to spool, twist, and store the material. The spindle of the flyer assembly having a flanged distal end journaled to a flyer head comprising a whorl pulley in conjunction with a drive band to cause the flyer assembly to rotate about the axis. The spindle of the flyer assembly rotatable about the axis relative to a rate of rotation of the flyer assembly. The material is evenly distributed onto the bobbin in a level wind pattern.

BRIEF DESCRIPTION OF THE DRAWINGS

FIG. 4 is a cross-sectional view of the flyer assembly and level wind device, according to an embodiment of the present disclosure in FIG. 2.

Corresponding reference numerals indicate corresponding parts throughout the several views of the drawings.

Figure 1:
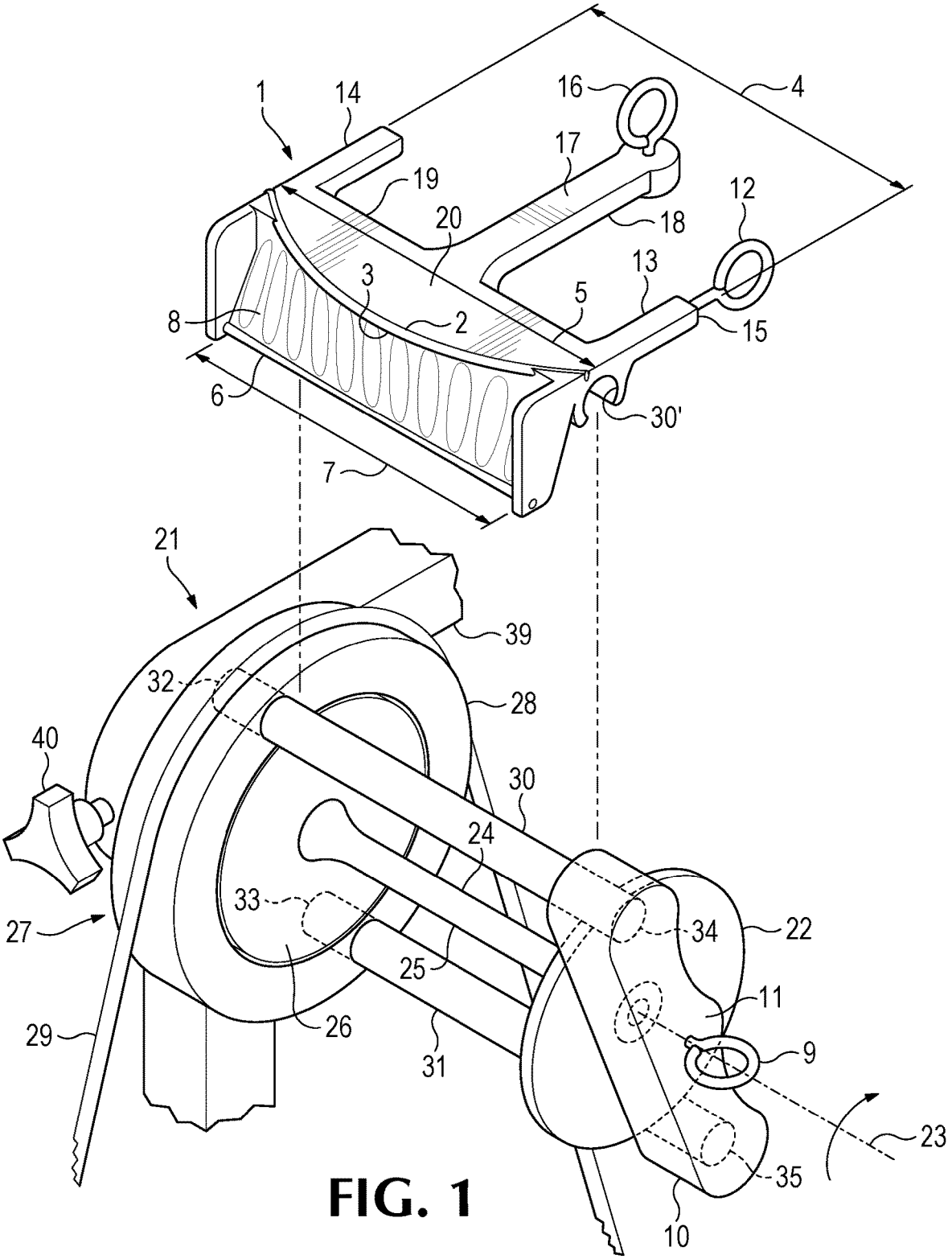
FIG. 1 is a top, front, perspective view of a flyer assembly and a level wind device, according to an embodiment of the present disclosure.

The drawings described herein are for illustrative purposes only of select embodiments and not all possible implementations, and are not intended to limit the scope of the present disclosure.

DETAILED DESCRIPTION

The claimed subject matter is described with reference to the drawings, wherein like reference numerals are used to refer to like elements throughout. In the following description, for purposes of explanation, numerous specific details are set forth in order to provide a thorough understanding of the subject innovation. It may be evident, however, that the claimed subject matter may be practiced without these specific details. In other instances, well-known structures and devices are shown in block diagram form in order to facilitate describing the subject innovation. Moreover, it is to be appreciated that the drawings may not be to scale.

With reference primarily to FIG. 1, a level wind device 1 is depicted. The level wind device 1 includes traversal rod 2, which forms convex curve 3, across the width 4, of the level wind device 1. Convex curve 3 has a length 5, spanning across the width 4 of the level wind device 1. Also included is tension rod 6, which has a length 7, linearly extending across the width 4 and offset from the traversal rod 2 of the level wind device 1.

In an embodiment, level wind device 1 can, but not necessarily, be constructed or manufactured from polyethylene terephthalate/polyethylene terephthalate glycol-modified (PET/PETG) using additive manufacturing. Additional suitable materials can include, but are not limited to, nylon, ABS (acrylonitrile butadiene styrene), resins and thermoplastic elastomers (TPE), polylactic acid (PLA), gold and silver, stainless steel, titanium, ceramics, and high impact polystyrene (HPS). The commercially available examples of the additive manufacturing materials of the level wind device 1 are not intended to preclude embodiments which incorporate similar or equivalent devices that are durable and can handle the rotation velocities and constraint of manual spinning wheels, currently or prospectively available.

Traversal rod 2 and tension rod 6 can, but not necessarily, be stainless steel, solid rod, which, with specificity to the traversal rod 2, can be bended to form convex curve 3. The commercially available examples of the manufacturing materials of the traversal rod 2 and tension rod 6 are not intended to preclude embodiments which incorporate similar or equivalent metals or metal alloys, currently or prospectively available that are malleable and have a sufficient hardness.

The space between the traversal rod 2 and tension rod 6 defines a front face 8 of the level wind device 1. The front face 8 can, but not necessarily, be shaped to be streamlined and include air flow holes in an ornamental and functional configuration.

In an embodiment, yarn Y frictionally engages the convex curve 3 of the traversal rod 2 along a length 5 of the convex curve 3 from one end to another, back and forth, in a sweeping fashion. Consequently, the yarn Y frictionally engages the tension rod 6 along a length 7 of the tension rod 6, back and forth, from one end to the other, in a sweeping fashion because the traversal rod 2 is offset from the tension rod 6. The traversal rod 2 and the tension rod 6 are wear parts subjected to friction, as well as constraint and tension. As such, the traversal rod 2 and the tension rod 6 are first and second friction members respectively in relation to the travel of the yarn Y.

In other embodiments, other materials besides yarn Y can, but not necessarily, be spooled. Additional materials can include thread, wire, cable, string, cord, and animal or plant fiber. The wear parts like the traversal rod 2 and tension rod 6 can be scaled, in order to handle materials with larger diameters. In addition, rollers made of polyurethane or metal alloy can be used in lieu of the traversal rod 2 and tension rod 6. Other materials that can, but not necessarily, be wound or spooled include materials of exceptionally long length having cross-sections in the shape of a square, rectangle, oval, trapezoid, triangle, or pentagon.

Figure 3:
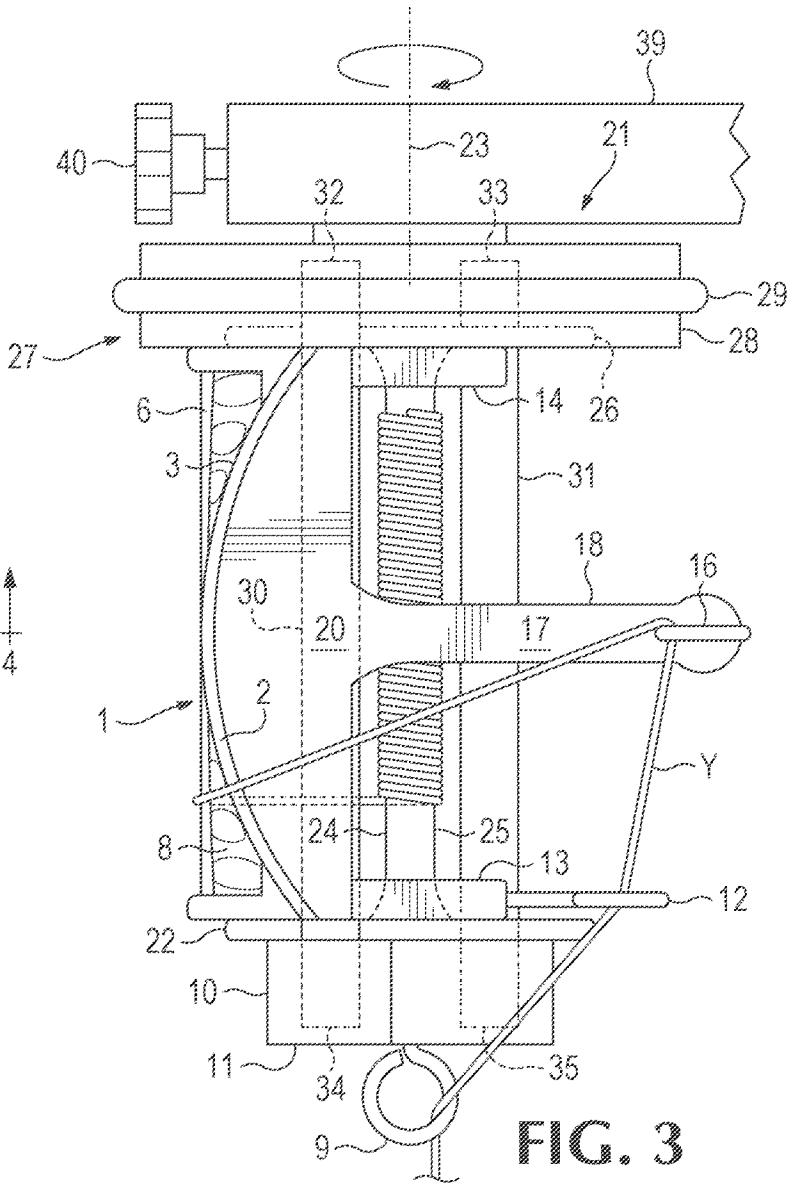
FIG. 3 is a top, plan view of a flyer assembly and a level wind device with the yarn orderly distributed on the bobbin, according to an embodiment of the present disclosure.
Figure 2:
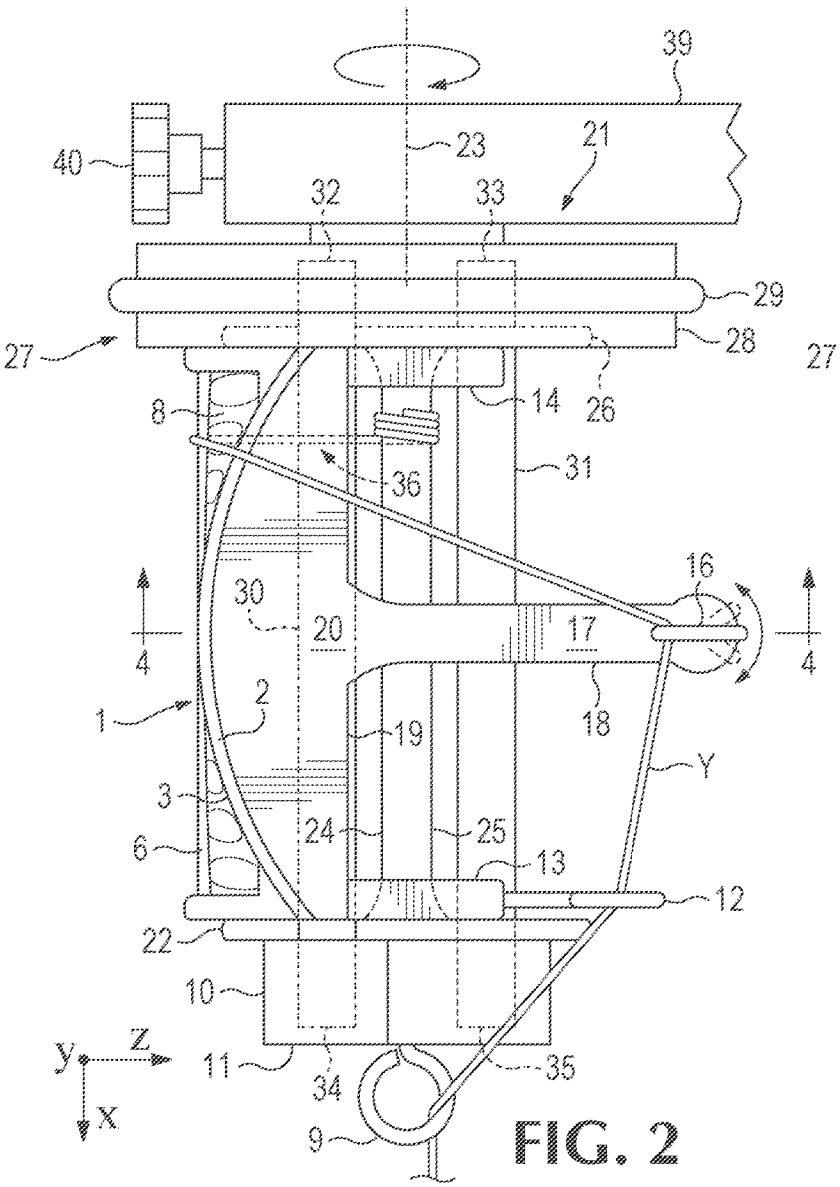
FIG. 2 is a top, plan view of a flyer assembly and a level wind device, according to an embodiment of the present disclosure.
Figure 5:
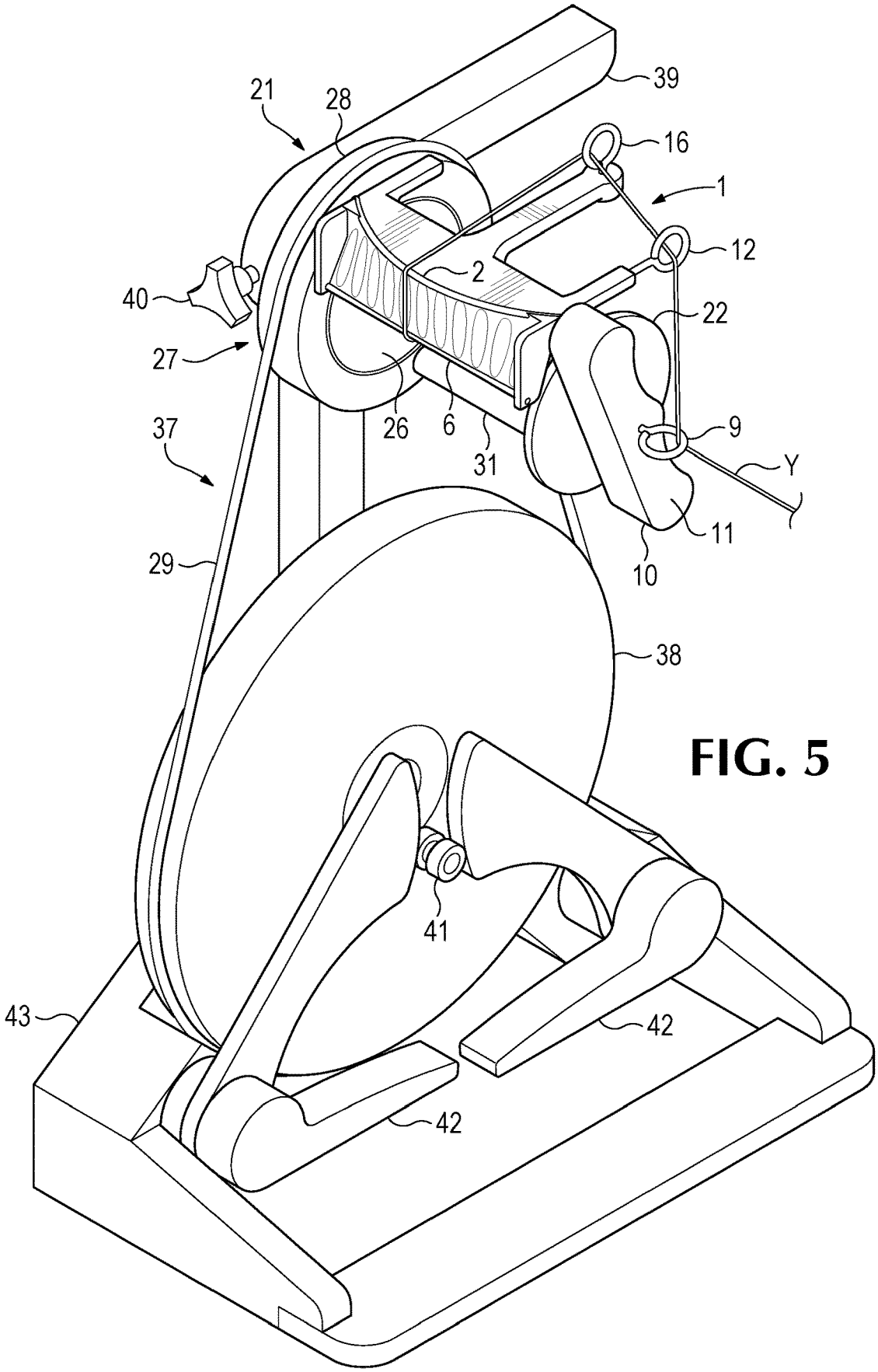
FIG. 5 is a top, front, perspective view of a treadle operated spinning wheel, a flyer assembly, and a level wind device, according to an embodiment of the present disclosure.

With reference to FIGS. 1-3, the yarn Y frictionally engages a plurality of eye hooks 9, 12, 16 in sequence before reaching the traversal rod 2. First, the yarn Y travels through an orifice eye hook 9 fastened to the hook orifice bar 10. Second, the yarn Y travels through a tether eye hook 12 fastened to proximal wing 13 of the level wind device 1, and third, through a fulcrum eye hook 16 fastened to a tail 18 of the level wind device 1.

Orifice eye hook 9 is secured to an outward face 11 of the hook orifice bar 10, substantially in alignment with the axis 23 of rotation. The tether eye hook 12 is secured to a rearward wall 15 of the proximal wing 13 of the level wind device 1. The fulcrum eye hook 16 is secured to a planar surface 17 of the tail 18 of the level wind device 1. Fulcrum eye hook 16 can provide a pivot point around which the yarn Y turns into the axial plane of the level wind device 1. The eye hooks 9, 12, 16 of the present disclosure can, but not necessarily, be shoulder eye bolts fastened to their respective positions on the hook orifice bar 10 and level wind device 1. Eye hooks 9, 12, 16 can be turned back and forth or twisted without being unscrewed, but removable, refastenable, and replaceable as necessary.

The commercially available examples of the eye hooks 9, 12, 16 of the level wind device 1 are not intended to preclude embodiments which incorporate similar or equivalent bolts, screws, and fasteners having eyes or hooks, currently or prospectively available.

With continuing reference to FIGS. 1-3, deck 19 is defined from a space between the proximal wing 13 and distal wing 14, and extending the planar surface 17 from the tail 18 up to the traversal rod 2 along the length 5 of the convex curve 3 from the proximal wing 13 to the distal wing 14. The deck 19 includes planar surface 20.

The illustrative example of the level wind device 1, is not intended to preclude embodiments which incorporate similar or equivalent structures used to define tensioning and twisting layouts for yarn Y travel that facilitate a level wind pattern, currently or prospectively available.

With reference to FIGS. 1-5, a manually operated spinning wheel 37 is a compound machine, in that it can perform two functions: i). the spinning wheel 37 facilitates a twisting of fibers together as they are fed into and through the orifice eye hook 9 to produce a twisted yarn Y, and ii). as a length of twisted yarn Y travels and spins, the spinning wheel 37 is used to takeup the yarn Y onto the spindle/spool 22 or bobbin 24 for storage. These two functions can be accomplished by a flyer assembly 21 also known as 'flyer' which partially surrounds the spool 22 and is built to rotate with relatively high revolutions per minute. The flyer assembly 21 is rotated by drive band 29 extending from the larger drive wheel 38 around the smaller whorl pulley 28 or 'whorl.'

The flyer assembly 21 can include spindle 22 for rotation about axis 23. The yarn Y is spooled onto bobbin 24 which can, but not necessarily, be flanged. The bobbin can include the shaft 25. The spindle 22 includes a flanged distal end 26 that is journaled to a flyer head 27. The flyer head 27 is made up of a whorl pulley 28 in conjunction with a drive band 29. In operation of spinning wheel 37, the drive wheel 38 actuates the drive band 29 that is looped to pass over the whorl pulley 28 of the flyer assembly 21, causing the flyer assembly 21 and spindle 22 to rotate about the axis 23. The flyer head 27 and the spindle 22 are driven at different rotational speeds about axis 23, thereby imparting the twist which produces a continuous yarn Y.

In an embodiment, the flyer assembly 21 can include a pair of hollow cylindrical arms 30, 31 that are radially spaced from the axis 23, disposed in diametric opposition to one another, and extending linearly in parallel with the axis 23. Each of the pair of cylindrical arms 30, 31 has a distal end 32, 33 and a proximal end 34, 35. Each distal end 32, 33 is removably coupled to the flyer head 27 of the flyer assembly 21 and each proximal end 34, 35 is removably coupled to the hook orifice bar 10 of the flyer assembly 21. The flyer assembly 21 and its encompassing structures are modular and can be readily installed in spinning wheels that are designed with the intention of using modular flyers and accessories.

The hollow cylindrical arms 30, 31 can, but not necessarily, be hollow wooden dowels. A dowel jig can be used to align the ends 32, 33 and 34, 35 of the cylindrical arms 30, 31 with corresponding holes drilled into the flyer head 27 and hook orifice bar 10 of the flyer assembly 21. Thus, each cylindrical arm 30, 31 can be removable, refastenable, and replaceable as coupled between the flyer head 27 and the hook orifice bar 10.

In an embodiment, the flyer assembly 21 and spinning wheel 37 can, but not necessarily, be made of wood. Wood, particularly hardwoods, work well in the construction of spinning wheels 37 because of the aesthetic design, making the spinning wheel 37 a keepsake. The commercially available example of wood as a material used to construct the level wind device 1 is not intended to preclude embodiments which incorporate similar or equivalent materials, currently or prospectively available.

With continuing reference to primarily FIGS. 1 and 4, level wind device 1 includes a rod-receiving recess 30' formed in the level wind device 1 to axially receive the correspondingly-shaped hollow cylindrical arm 30 of the pair of hollow cylindrical arms 30, 31. Hollow cylindrical arm 31 of the pair of hollow cylindrical arms 30, 31 can be a counterbalance and suitably weighted to balance the weight of the level wind device 1 axially mounted to hollow cylindrical arm 30.

With continuing reference to primarily FIGS. 2 and 4, yarn Y travels from the tension rod 6 to the bobbin 24 at an angle 36. In the distribution of the yarn Y onto the bobbin 24, the yarn Y moves back and forth along the length of the tension rod 6 in the y-direction, then the yarn Y is downward angled 36 in the z-direction to be received by the bobbin 24 through the combined effect of torque and friction forces.

In an embodiment, during the operation of the spinning wheel 37, the distance of the yarn Y between the fulcrum eye hook 16 to the tension rod 6 is constant, when fulcrum eye hook 16 is centered, as shown in FIG. 4, to provide a pivot point in alignment with the sagittal plane and perpendicular to the axial plane. This distance having a fixed value is passed on as the yarn Y continues to travel, such that the turnaround ends of each layer of wound yarn Y are equidistant from the apex of the convex curve 3 of the traversal rod 2 thus, distributing a level wind pattern.

In an embodiment, the level wind pattern can be adjusted by twisting or turning the fulcrum eye hook 16 to one side or the other. This causes the distance of yarn Y between the fulcrum eye hook 16 and the tension rod 6 to vary, thereby changing the dwell points of the yarn Y along the axial length of the bobbin 24 to be biased toward the side in which the fulcrum eye hook 16 is twisted or turned. As depicted in FIG. 2, the fulcrum eye hook 16 can be twisted or turned, for example, in the direction toward the flanged distal end 26 of the spindle 22. This will cause a dwell point to result along the axial length of the bobbin 24 on the distal end 26. Thus, instead of a level wind pattern, a tapered pattern can be achieved. The dwell points and resultant wind patterns can be adjusted depending on the direction and the degree to which the fulcrum eye hook 16 is turned.

With continuing reference to primarily FIGS. 2, 3, 4, and 5, spool 22 or bobbin 24 are configured to rotate independently of the flyer head 27, which can rotate continuously by way of the drive wheel 38 being rotated by treadle 42. A brake 40 can, but not necessarily, be a thumb screw to adjust the rate of rotation of the spool 22 relative to the flyer head 27. Drive wheel 38 can be connected by conventional linkage mechanisms 41 to treadle 42 or 'foot treadles' for rotational movement of the drive wheel 38 by reciprocating movement of the treadle 42 by an operator or 'spinner.' Spinning wheel 37 can include a carrying handle 39 for easier portability and a support stand 43 to maintain the spinning wheel 37 in an upright position and support the other parts of the spinning wheel 37 during use and operation.

The present teachings thus advantageously provide for a level wind device 1, a flyer assembly 21 with a level wind device 1, and a spinning wheel 37 with the flyer assembly 21 and the level wind device 1. The present teachings provide for numerous other advantages as well, as will be recognized by one skilled in the art.

The description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used is for the purpose of describing particular example embodiments only and is not intended to be limiting. The singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It is understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, quadrants, thirds, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 routes refers to groups having 1, 2, or 3 routes. Similarly, a group having 1-5 impact zones, for example, refers to groups having 1, 2, 3, 4, or 5 impact zones and more or less, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims. All references recited herein are incorporated herein by specific reference in their entirety.

What is claimed is:

1. A flyer assembly including a spindle rotatable about an axis of rotation, comprising:

a bobbin onto which yarn is spooled in operation of a spinning wheel used to spool, twist, and store the yarn, the bobbin comprising a shaft of the spindle, the spindle having a flanged distal end journaled to a flyer head comprising a whorl pulley in conjunction with a drive band to cause the flyer assembly to rotate about the axis, the spindle rotatable about the axis relative to a rate of rotation of the flyer assembly;

a pair of hollow cylindrical arms radially spaced from the axis and disposed in diametric opposition to one another while extending substantially parallel to the axis, each of the pair of cylindrical arms having a proximal end and a distal end, each distal end removably coupled to the flyer head of the flyer assembly and each proximal end removably coupled to a hook orifice bar of the flyer assembly; and a level wind device axially mounted to the first cylindrical arm of the pair of cylindrical arms and disposed along a length of the first cylindrical arm of the flyer assembly, the level wind device comprising a traversal rod disposed along a width of the level wind device, the yarn evenly distributed onto the bobbin in a level wind pattern, wherein the traversal rod of the level wind device comprises a convex curve defining the width of the level wind device, the yarn frictionally engages the convex curve of the traversal rod along a length of the convex curve from one end to another, back and forth, in a sweeping fashion in operation of the spinning wheel.

2. The flyer assembly of claim 1, wherein the level wind device further comprises a tension rod, the yarn frictionally engages the tension rod along a length of the tension rod, back and forth, from one end to another in operation of the spinning wheel, then the yarn travels from the tension rod to the bobbin at an angle relative the axis of rotation, the traversal rod and the tension rod defining a front face therebetween of the level wind device.

3. The flyer assembly of claim 2, wherein the yarn frictionally engages a plurality of eye hooks in sequence before reaching the traversal rod, first, the yarn travels through an orifice eye hook fastened to the hook orifice bar, then second, through a tether eye hook fastened to a proximal wing of the level wind device, and third, through a fulcrum eye hook fastened to a tail of the level wind device in operation of the spinning wheel, the orifice eye hook secured to an outward face of the hook orifice bar, the tether eye hook secured to a rearward wall of the proximal wing of the level wind device, and the fulcrum eye hook secured to a planar surface of the tail of the level wind device.

4. The flyer assembly of claim 3, wherein the level wind device further comprises:

a deck comprising a planar surface defined from a space between the proximal wing and a distal wing, and extending the planar surface from the tail up to the traversal rod along the length of the convex curve from the proximal wing to the distal wing.

5. The flyer assembly of claim 3, wherein a distance of yarn between the fulcrum eye hook and the tension rod comprises a fixed distance in operation of the spinning wheel.

6. The flyer assembly of claim 5, wherein the distance of yarn between the fulcrum eye hook and the tension rod varies when the fulcrum eye hook is turned toward one side or another.

7. The flyer assembly of claim 1, wherein the level wind device comprises a rod-receiving recess formed therein to receive the first hollow cylindrical arm of the pair of hollow cylindrical arms.

8. The flyer assembly of claim 7, wherein the second hollow cylindrical arm of the pair of hollow cylindrical arms comprises a weight.

9. An apparatus including a spindle having an axis of rotation, comprising:

an arm coupled to the spindle and radially spaced from the axis of rotation extending substantially parallel to the axis, comprising:

a level wind device axially mounted to the arm;

a first friction member disposed along a width of the level wind device and shaped into a convex curve defining the width of the level wind device;

a second friction member offset from the first friction member linearly extending along the width of the level wind device; and a fulcrum having an eye or hook, the fulcrum pivotally adjustable, wherein a material of length threaded through the eye or the hook of the fulcrum frictionally engages the first friction member followed by the second friction member in an operation of spooling the material around the spindle, the spindle rotatable about the axis to receive the material from the second friction member.

10. The apparatus of claim 9, wherein the first friction member and the second friction member comprise rollers.

11. The apparatus of claim 9, wherein the material of length comprises thread, wire, cable, string, cord, and fiber.

12. The apparatus of claim 9, wherein a distance of material between the fulcrum and the second friction member comprises a fixed distance throughout the spooling operation.

13. The apparatus of claim 12, wherein the distance of material between the fulcrum and the second friction member varies throughout the spooling operation by way of pivotally adjusting the fulcrum.

14. A flyer assembly including a spindle rotatable about an axis of rotation, comprising:

an arm coupled to the spindle and radially spaced from the axis of rotation extending substantially parallel to the axis;

a level wind device axially mounted to the arm;

a first friction member disposed along a width of the level wind device and shaped into a convex curve defining the width of the level wind device;

a second friction member offset from the first friction member linearly extending along the width of the level wind device; and a fulcrum having an eye or hook, the fulcrum pivotally adjustable, wherein a material of length threaded through the eye or the hook of the fulcrum frictionally engages the first friction member followed by the second friction member in operation of a spinning wheel used to spool, twist, and store the material, wherein the spindle having a flanged distal end journaled to a flyer head comprising a whorl pulley in conjunction with a drive band to cause the flyer assembly to rotate about the axis, the spindle rotatable about the axis relative to a rate of rotation of the flyer assembly, the material of length evenly distributed onto the spindle in a level wind pattern.

* * * * *